US005484215A

United States Patent [19]

Fillod et al.

[11] Patent Number: 5,484,215

[45] Date of Patent: Jan. 16, 1996

[54] TICKET ISSUING DEVICE FOR A TICKET PREPARING AND ISSUING MACHINE

[75] Inventors: Maurice Fillod; Daniel Gautherot, both of Besancon, France

[73] Assignee: Schlumberger Industries, Montrouge, France

[21] Appl. No.: 390,334

[22] Filed: Feb. 17, 1995

[30] Foreign Application Priority Data

Feb. 17, 1994 [FR] France ..... 94 01812
Mar. 29, 1994 [FR] France ..... 94 03659

[51] Int. Cl.[6] ..... B41J 2/325; B41J 3/44

[52] U.S. Cl. ..... 400/120.18; 400/77; 400/74; 400/611; 400/621; 101/66; 101/227; 235/375

[58] Field of Search ..... 400/120.18, 77, 400/119, 611, 621; 101/66, 227; 235/375

[56] References Cited

U.S. PATENT DOCUMENTS 1,332,386 3/1920 Dwyer .
3,651,503 3/1972 Kono ..... 101/66
3,709,145 1/1973 Williamson ..... 101/66
4,262,591 4/1981 Cook ..... 101/92
4,347,525 8/1982 Moore et al. ..... 101/22
5,168,814 12/1992 Kuzuya et al. ..... 400/120.18
5,302,034 4/1994 Kitazawa ..... 400/120.18

FOREIGN PATENT DOCUMENTS

0366148A2 5/1990 European Pat. Off. .
0473137A2 3/1992 European Pat. Off. .
1508988 4/1978 United Kingdom .

OTHER PUBLICATIONS

Patent Abstracts of Japan, vol. 7, No. 98 (M–210) Apr. 26, 1983 & JP–A–58 022 252 (Tokyo Shibaura Denki KK).

*Primary Examiner*—Eugene H. Eickholt
*Attorney, Agent, or Firm*—Frishauf, Holtz, Goodman, Langer & Chick

[57] ABSTRACT

A device for preparing and issuing tickets, especially travel tickets. The preparing means comprise a flywheel cooperating with a belt to feed a cut ticket in front of a magnetic writing head and a magnetic reading head and a printing roller. Outside the region of entrainment of the tickets by the flywheel, the tickets move in channels formed by the plates.

23 Claims, 9 Drawing Sheets

TICKET ISSUING DEVICE FOR A TICKET PREPARING AND ISSUING MACHINE

BACKGROUND OF THE INVENTION

The present invention relates to a device for preparing and issuing tickets, especially travel tickets.

The invention concerns a machine which can prepare tickets, especially travel tickets, most often having part of the information printed, especially by thermal printing, and also preferably having information recorded on a magnetic track. Such machines should prepare a complete ticket in response to the information fed in by the user relating for example to its destination, the class and the tariff, and issue it after payment of the corresponding price, this payment being effected by cash or bank or other card.

Such machines are often installed in public places, such as railroad stations, subway stations, etc. Moreover, the number of uses of such a machine in a day is high and a fault in operation is very costly. They must be rugged and reliable.

In the case of some travel tickets, the face value of the tickets can be very high. It is, thus, important that the physical medium serving for preparing these tickets should not be capable of being stolen, whether by users or by maintenance personnel for the machines, with a view to making counterfeit tickets.

It will also be understood that, with multi-service machines, it is necessary to use several media for preparing the tickets, for example to prepare subway tickets, train tickets, or tickets for the Regional Express Network. It is, thus, necessary that the same machine should be able to prepare these different tickets. It is also desirable that such machines should be as compact as possible so that they can easily be located in suitable public places and in order to reduce their cost.

SUMMARY OF THE INVENTION

An object of the present invention is to provide a device for preparing and issuing tickets which carry information in magnetic form, in which the magnetic recording means are simplified and permit writing information while requiring only a single pass of the ticket under the write head.

In order to meet this and other objects of the invention, the device for preparing and issuing tickets carrying information in magnetic form includes means for providing portions of recording physical medium having the length of a ticket, means for recording magnetic information on the recording medium and means for issuing tickets. The means for recording magnetic information comprise: a flywheel pivotally mounted about an axis and having a peripheral surface. A flexible, endless belt is provided for entraining portions of ticket medium, and entraining means causes displacement of one of the two parts constituted by the belt and said flywheel. Guide means guides said belt such that the path followed by said belt has a part in which it is applied under pressure to a peripheral part of the peripheral surface of the flywheel, through which the two parts are entrained for movement by mutual friction. Engaging means engage a first end of a portion of ticket medium between the part of said belt that is in contact with the periphery of said flywheel and the peripheral surface of said flywheel, whereby said portion of medium is entrained by the rotation of said flywheel through nipping between the belt and the peripheral surface over the part of its periphery to which said belt is applied, then freed outside said peripheral part. A magnetic recording means is disposed opposite the part of the peripheral surface of the flywheel to which said belt is applied.

It will be understood that, because of the use of the flywheel to move the ticket past the magnetic writing head, the displacement thereof takes place at a controlled speed, without discontinuity. It is, thus, possible to effect the recording by means of a single pass in front of the writing head. Furthermore, the ticket nipped between the belt and the periphery of the flywheel does not slip.

It is preferably the flywheel which is coupled mechanically to the entraining means.

Also for preference, the device for preparing and issuing tickets comprises testing means for testing whether each prepared ticket is valid or invalid and means for issuing valid tickets to users at the output of the device and for retaining invalid tickets. The issuing means comprise a guide channel for tickets which have been prepared, a receptacle for prepared valid tickets, said receptacle being provided with an external opening allowing users to take hold of a ticket, a seat in communication with the end of the guide channel and in communication with said receptacle through an outlet opening of small dimensions adapted to allow passage of a ticket, and movable means mounted in said seat. The movable means comprises a first surface and a second surface and defining a collecting enclosure for invalid tickets, a passage extending between said first and second surfaces and adapted to contain a ticket, and blocking means for blocking the end of said channel and said outlet opening. Shifting means shifts said movable means between a first position in which one end of said passage faces the end of said channel and in which the other end does not face the outlet opening, and in which the blocking means block said outlet opening, a second position in which said collecting enclosure faces the end of said channel and in which said blocking means block said outlet opening, and a third position in which said blocking means block the end of said channel and in which the second end of said passage faces said outlet opening.

Again for preference, the device for preparing and issuing tickets comprises means for supplying a physical medium for preparing tickets, wherein the supply means comprise a receptacle, movable in a direction XX' relative to the means for preparing tickets, for receiving n rolls of physical medium strip. Each roll is adapted to rotate about an axis YY' parallel to the direction XX', said rolls being disposed side by side in such a manner that their axes of rotation are parallel. An enclosure is provided in which said receptacle is movably mounted, said enclosure having a wall substantially parallel to said direction of movement and provided with an opening adapted to allow passage of said physical medium strip. The opening opens into a space of said device containing said means for preparing tickets. A number n of anti-return devices is made integral with said receptacle, each anti-return device being adapted to keep the free end of a strip opposite said opening, said anti-return device in the active position allowing only unfeeling of said roll. Means is provided for displacement of said receptacle in the direction XX' relative to said preparing means, in order to place the free end of a selected one of said n strips opposite said opening.

Another object of the invention is to provide a roll of physical medium strip for preparing tickets which will be protected against attempts at fraud which could be perpetrated by maintenance employees for the device when reloading the device with rolls to be placed in the storage module.

This object is met by specific items of data magnetically recorded on the magnetic track and/or printed, which items are read by the recording module of the device and are made use of by this module and/or by the ticket outlet module.

BRIEF DESCRIPTION OF THE DRAWINGS

Various features and advantages of the present invention will be readily apparent from a reading of the following description of an embodiment of the invention, given by way of non-limiting example. The description refers to the accompanying drawings, in which.

MORE DETAILED DESCRIPTION

Figure 1:
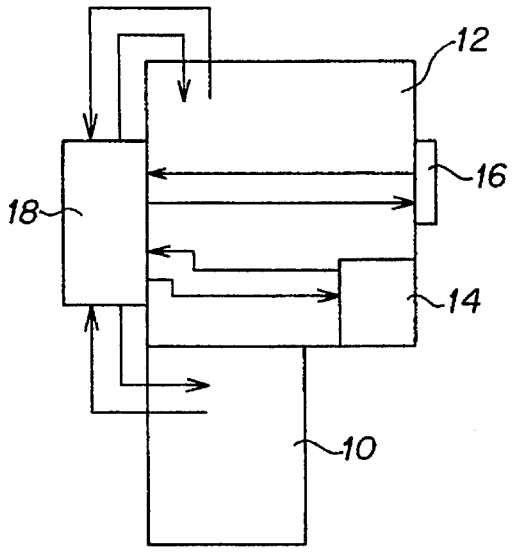
FIG. 1 is a simplified view showing the general organization of the device for issuing tickets.

Referring firstly to FIG. 1, the general organization of the device for preparing and issuing tickets will be described. The device essentially comprises a lower compartment 10 for storing rolls of paper or like strips serving to make the travel tickets, an upper compartment 12 comprising means effecting preparation of the ticket, i.e. essentially magnetic and thermal information recording means for making the particular ticket requested, and associated with an output module 14 which monitors output of the ticket that has been prepared and which prevents some acts of vandalism. The device for preparing tickets comprises an interface panel 16 which firstly allows users to select the particular ticket or tickets they want to obtain and to pay the corresponding amount in order to obtain the tickets, and secondly allows an employee to carry out various maintenance operations. Finally the device includes a set of electrical and electronic circuits 18 which control the assemblies of the device for issuing tickets. These circuits monitor and control the operation of the various parts of the device in response to operation of the interface means 16, whether they are operated by a user to get one or more tickets issued or they are operated by a maintenance employee for the machine. The electrical connections which are present between the various parts of the device and which are explained below are also shown in FIG. 1 in a schematic manner.

Figure 2:
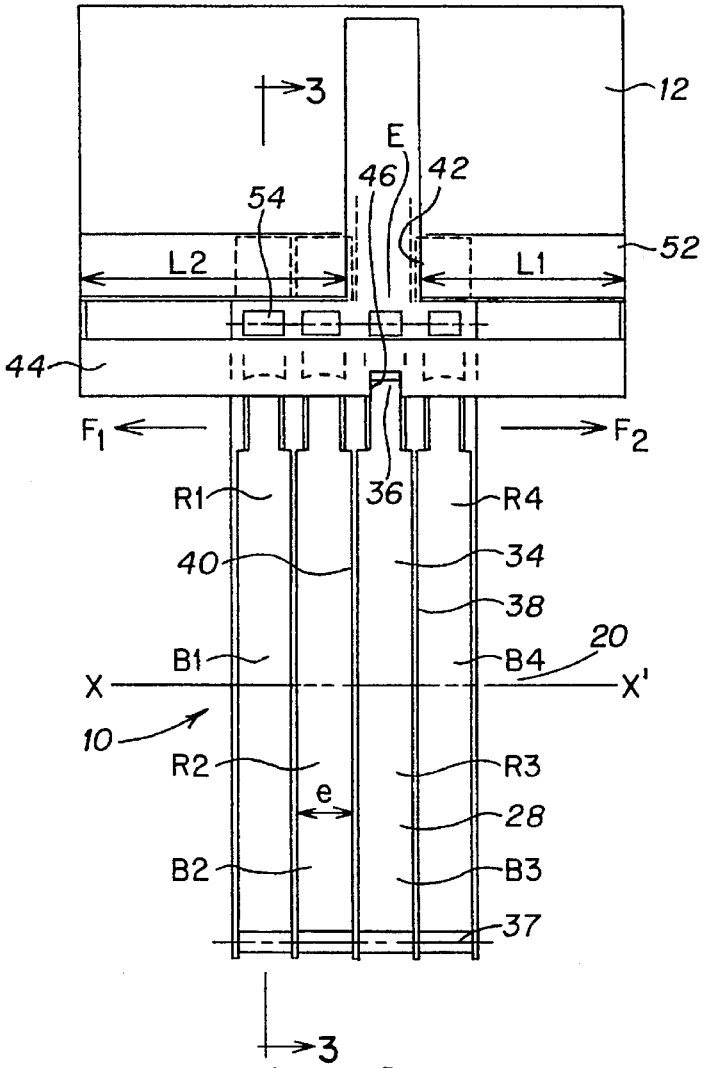
FIG. 2 is a partial front view of the storage compartment for rolls of recording medium.
Figure 4:
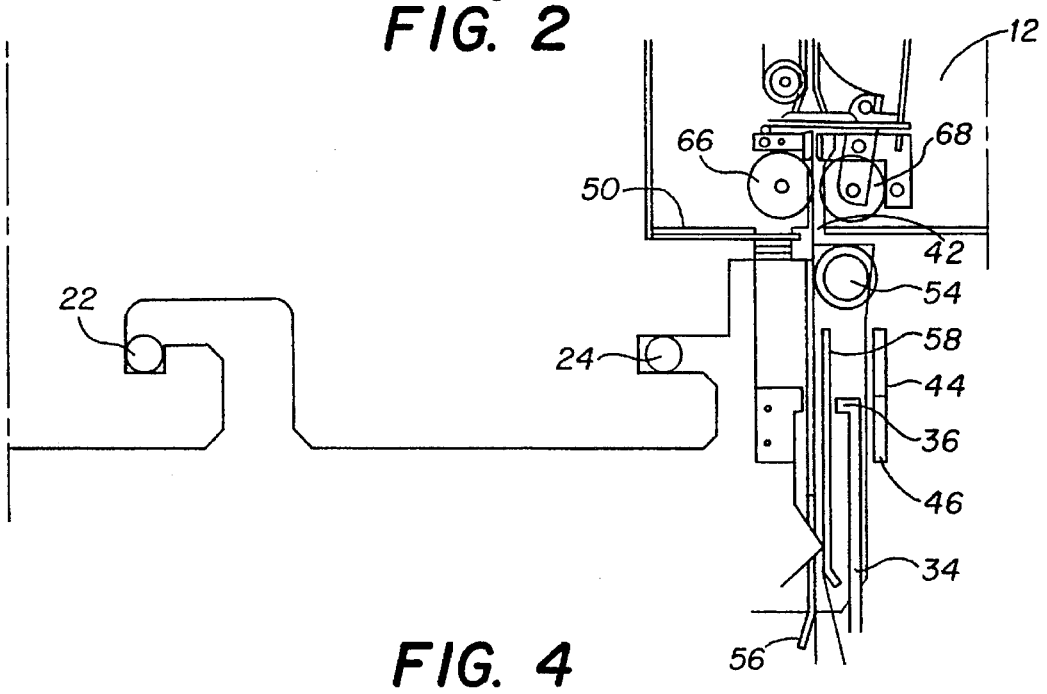
FIG. 4 is a partial view of the storage compartment showing the passage of the strip of medium from the storage compartment to the printing compartment.
Figure 3:
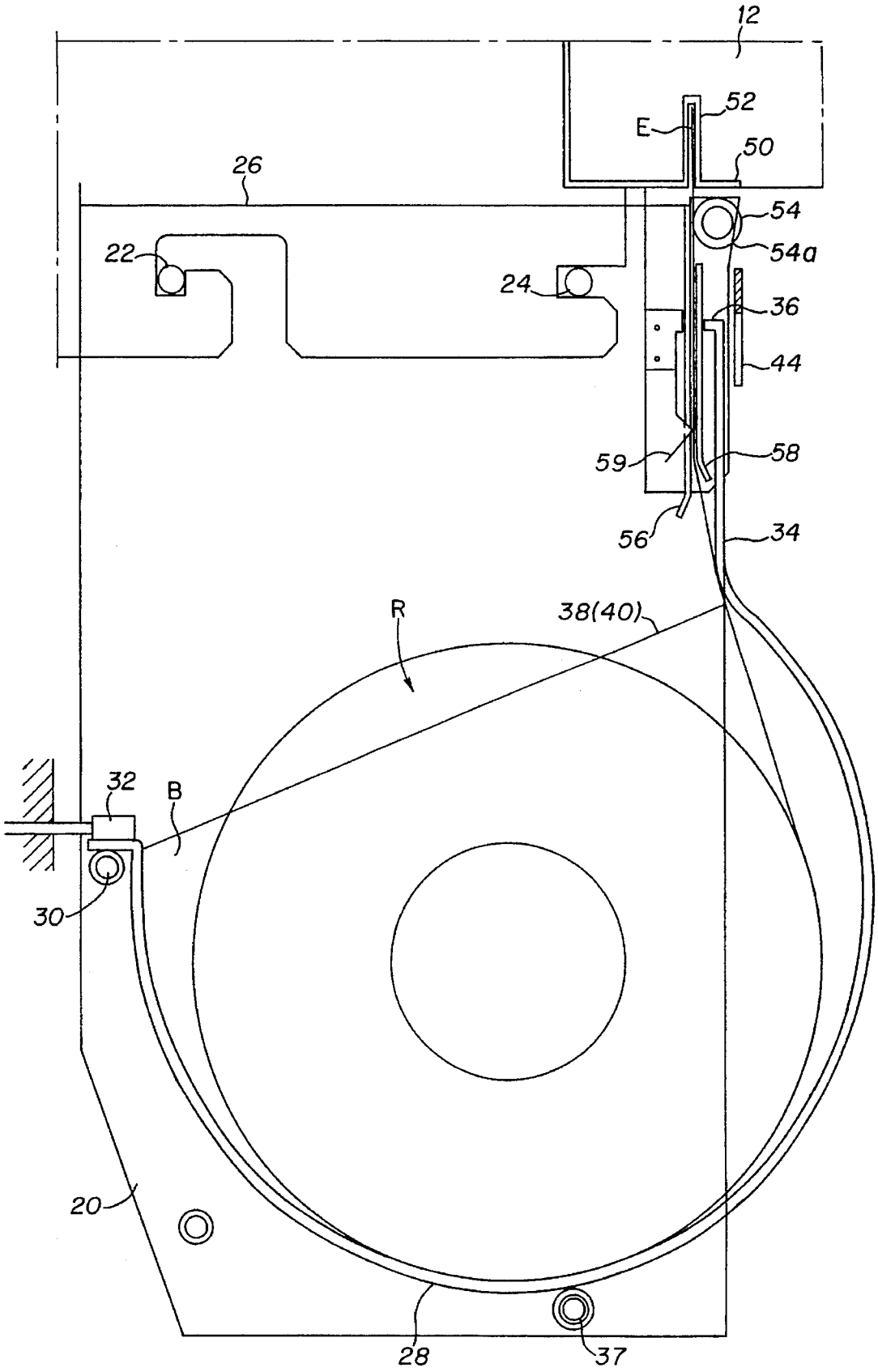
FIG. 3 is vertical section on the line III in FIG. 2 of the storage compartment.

Referring now to FIGS. 2 to 4, there will be described a preferred manner of implementing the lower compartment 10 for storing the rolls of paper for making the tickets. In the embodiment described, the compartment 10 allows four rolls of medium referenced R1, R2, R3 and R4 in FIG. 2 to be stored and each roll can consist of a respective medium for creating different types of ticket or these rolls can correspond to only two different types of medium, a first roll of a first medium type being used when the second roll of the same type is used up. The strip of medium comprises a magnetic track disposed on a first face and a thermally printable surface on the second face. Each roll R1, R2, R3, R4 is disposed inside a box B1, B2, B3, B4, these boxes themselves being part of a carriage 20 which is suspended on rods 22, 24 for example integral with the upper wall 26 of the lower compartment. It will thus be understood that the carriage 20 can be shifted as a whole inside the compartment 10 in the direction of the arrows F1 and F2, i.e. in a direction parallel to the axis XX' of the various rolls R. Each box B has a movable wall comprising a part in the shape of a portion of a cylindrical surface 28, whose one inner end 30 is preferably provided with an interlocking member 32 on the carriage 20. The part of the cylindrical wall 28 on the front face of the device for issuing tickets extends into a substantially flat part 34, which terminates in a stiffening edge 36. The entire wall 28, 34 is mounted to pivot relative to the movable carriage 20 about an axis 37. The rolls R of medium rest freely on the bottom of the cylindrical part of the wall 28. Each box B is completed by two fixed sidewalls 38 and 40. It will thus be understood that each roll R rests freely on the bottom of a box B. Accordingly, on pulling the free end E of the strip of paper, the roll is caused to rotate and the strip unreels.

Motor means, not shown in the drawings, enable the assembly of the carriage 20 to be shifted as a whole, as already indicated, in the directions F1 and F2. As will be explained later, the purpose of these shifts is to allow each of the boxes, and thus each of the rolls R, to be brought opposite a fixed opening 42 formed in the upper wall 26 of the compartment 10, which allows the end E of the strip of paper to be introduced into the compartment 12 for printing tickets. These shifting means can consist in making the rods 22 and 24 threaded and suspending the carriage 20 on threaded tongues cooperating with the rods. The motor means allow the rods to be rotated.

If the width of each box B in the direction of displacement is called e, with e accordingly the width of the opening 42 in the same direction, the length L1 of the displacement to the right of the opening 42 is equal to at least 3 times the distance e, while the length of the displacement L2 on the other side of the opening 42 is equal to at least 4 times e. It will thus be understood that the displacement of the carriage 20 can bring each box opposite the opening 42 and can moreover shift the carriage 20 in such a manner that no box faces the opening 42. In order to reach this position the carriage has to be shifted fully in the direction F1.

The various boxes are kept in the closed position, i.e. the position shown in FIG. 3, in part by a vertical plate 44 integral with the frame of the device. The closing ends 36 of the movable walls of the various boxes are engaged behind the plate 44, which ensures that they are immobilized. However, the plate 44 is provided with a cut-out 46 in correspondence with the position of the opening 42. When the wall 34 of the box faces the cut-out 46, the end 36 of the wall of the box is free. The fixed interlocking device 32 is in register with the cut-out 32, i.e. it acts on the end 30 of the box which faces the opening 42. The interlocking device 32 is electrically controlled by the control circuit 18. It is thus possible to effect opening of a box by swinging its movable wall about the axis 37, only if this box is both opposite the cut-out 46 and the control circuits have also released the interlocking device 32. This control of the interlocking device only takes place if the roll in the corresponding box is empty. The importance of this arrangement, which is related to controlling access to the ticket medium rolls by the maintenance employee, will be explained later.

Figure 8:
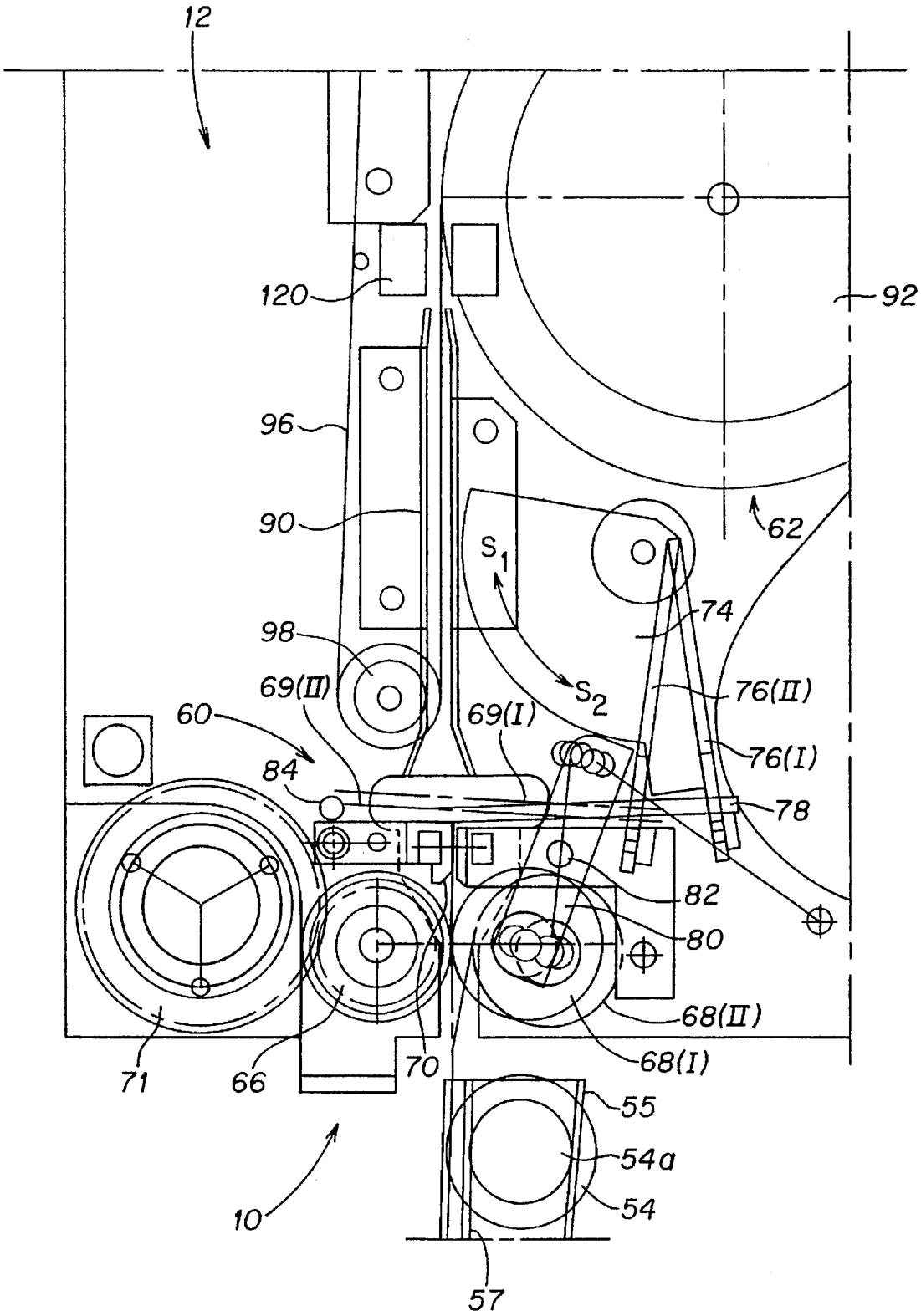
FIG. 8 is a view like that of FIG. 7 showing the cutting means in different positions.

The compartment containing the carriage 20 has a substantially horizontal upper wall 50 which has a folded part 52 projecting upwardly from the wall 50, i.e. into the interior of the printing compartment 12. This folded part 52 extends in the direction of displacement of the carriage. The folded part 52 is intended to receive the end E of each strip of paper medium. As shown better in FIG. 2, the opening 42 which has already been referred to is formed in the folded part 52. It will thus be understood that the end E of the spool of the paper roll R disposed in the box B which is opposite the opening 42 has two surfaces which are free and located inside the upper compartment 12 of the ticket issuing device. As will be explained in more detail later, it is then possible for the means for preparing the ticket to grasp the end of the strip of ticket medium and to draw off the length required to effect printing. In order to guide the end E of the paper strip in the box B and to ensure that its end E is kept inside the folded part 52, an anti-return roller 54 is provided, being mounted in the carriage 20 opposite the box and cooperating with guide plates 56 and 58 for the paper strip. It will be understood that the function of the anti-return roller 54 is to prevent the end E of the strip of paper dropping down while allowing the strip of paper to emerge from the lower compartment when it is pulled. The anti-return roller 54 is for example formed by a cylinder whose ends 54*a* are engaged between guide plates 55 and 57 which flare out upwardly. An upward pull on the end of the medium paper frees the roller 54. On the contrary, a downward pull on the strip caused the roller to jam between the guide plates 55 and 57. (FIG. 8 shows this situation clearly). A movable contact, for example a spring 59 or any other means, optical for example, enables the end of the strip in the corresponding box to be detected in the region of the anti-return roller. This information is transmitted to the control circuits 18 of the device. The distance between the detector 59 and the axis of the anti-return roller is preferably at least equal to the standard length of a ticket.

As shown in FIGS. 3 and 4, the strip of medium is engaged between the roller 54 and the upper end of the strip guide plate 56.

Referring now to FIGS. 5 to 10, the printing or recording module 12 of the device for preparing and issuing tickets, especially travel tickets, will now be described. Within the casing of this compartment there are essentially a first assembly 60 for engaging the end of the paper strip above the storage region and for cutting off the strip in order to remove therefrom a portion of medium corresponding to one ticket, a magnetic recording section 62 formed essentially by means for entraining the cut ticket and for magnetic writing to record information and finally a graphical printing section 64 for printing the ticket.

Figure 7:
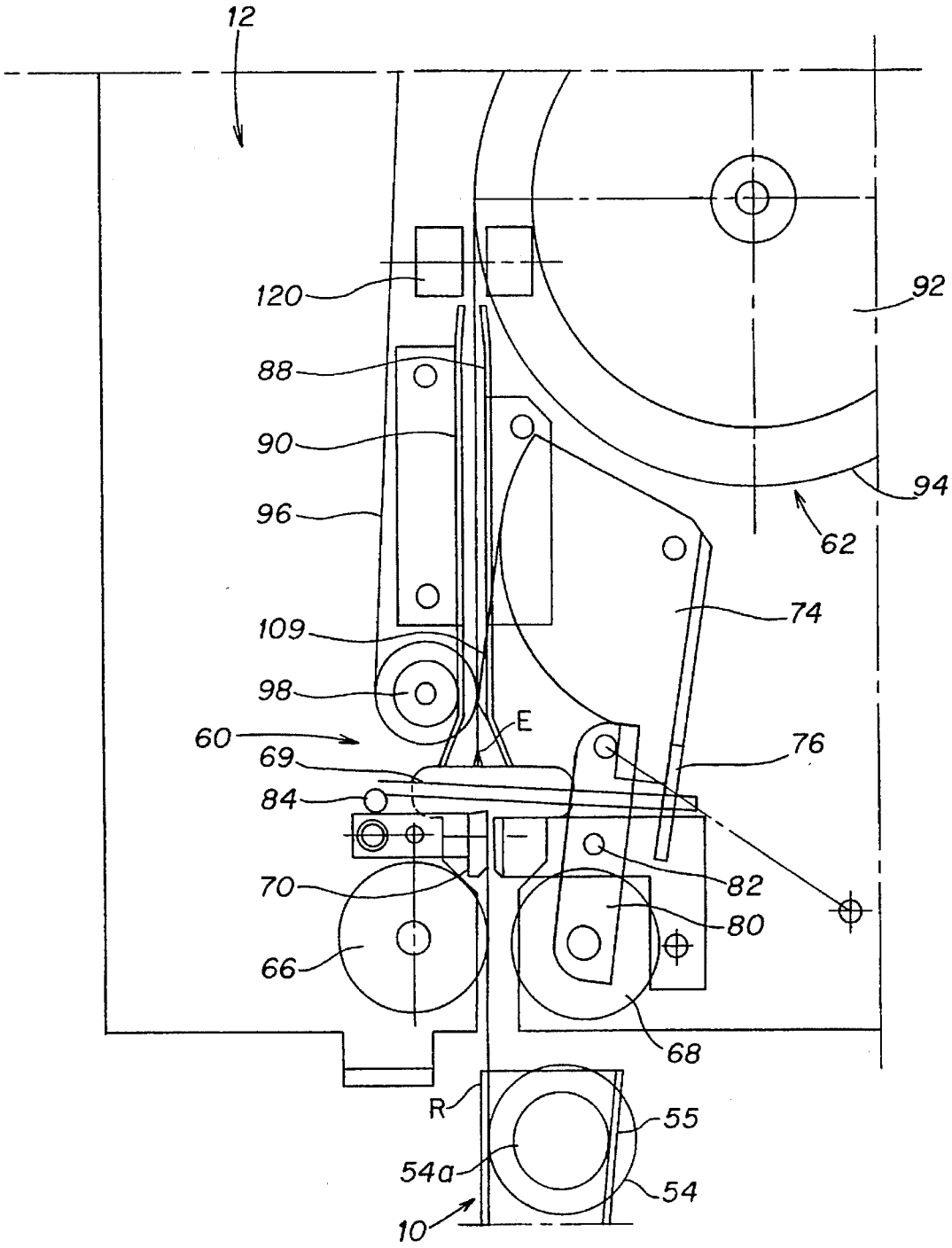
FIG. 7 shows the part of the recording compartment with the means for cutting off the strip of medium.

Referring more particularly to FIG. 7, the assembly 60 for engaging the strip of medium and for cutting off the ticket will be described. The means for extracting the strip from the storage compartment 10 are formed essentially by an entraining roller 66 mounted opposite a pressure roller 68, which can assume a disengaged position as shown in FIG. 7 or an active position as will be explained later. The rollers 66 and 68 are disposed on the two sides of the opening 42 formed in the folded part 52 of the storage container 10. Thus, the rollers 66 and 68 can act on the two surfaces of the end E of the paper strip when the corresponding box has been brought opposite the opening 42. The ticket cutting device is formed essentially by a movable blade 69 and a fixed blade 70. These two blades are located above the rollers 66 and 68. As better shown in FIG. 8, the entraining roller 66 is coupled to a drive member 71, namely a motor, which is controlled by the set of control circuits 18 of the ticket issuing device. The roller 66 is controlled in such a manner that its rotation causes upward displacement of the end of the strip of paper when the roller 68 is in active position.

Figure 6:
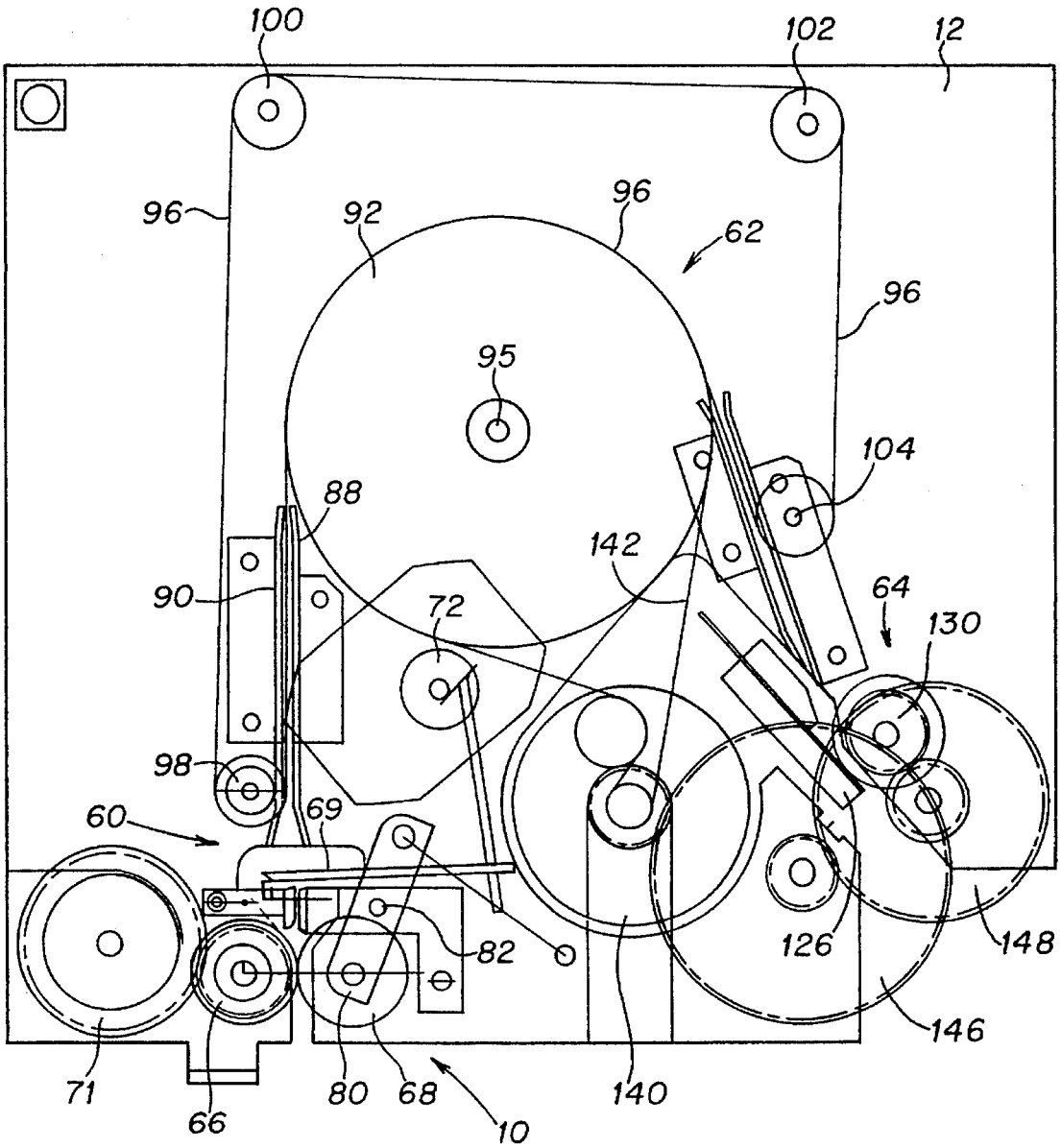
FIG. 6 is a view similar to that of FIG. 5 of the recording compartment but showing the members for driving various components of the recording compartment.

As better shown in FIGS. 6 and 8, the displacement of the pressure roller 68 as well as the displacement of the movable blade 69 are controlled by the same drive member 72 seen in FIG. 6. This drives a cam 74 on which is fixed a lever 76 connected to the control end 78 of the blade 69. The roller 68 is mounted on a first end of lever arm 80 pivoted on a pivot 82 fixed to the frame. The second end of the lever 80 is connected to the cam 74. It will be understood that rotation of the cam 74 in the direction S1 causes the blade 69 to be shifted into its position shown in FIG. 7, i.e. its active position, and that the cam causes retraction of the pressure roller 68 because of the reversal effected by the lever 80. Rotation of the cam in the direction S2 causes retraction of the blade 69 and sets the roller 68 into its active position. FIG. 8 shows the roller 68 and the blade 69 in their two extreme positions I and II. More specifically, when rotation of cam 74 is effected in the direction S1, lever 76 is pivoted from position 76(I) to position 76(II), thus causing blade 69 to move from position 69(I) to position 69(II) at the end of its stroke. Simultaneously, cam 74 acts on one end of lever 80. Since lever 80 has a fixed point 82, roller 68 attached to the other end of lever 80 is retracted from position 68(I) to position 68(II) when the blade is near the end of its stroke, i.e. when the cutting has already taken place. Thus the strip of medium is nipped between the rollers 66 and 68 during the entire cutting stage.

As also seen in FIGS. 7 and 8, there is a member 84 for raising the blade 69 when it is in the position shown in FIG. 7. This raising is made possible because of the non-rigid connection of the control end of the blade to the lever 76. The significance of this raising is as follows. The end E of each of the strips is retained in the folded region 52 of the wall 50 by the anti-return roller 54. The free edge of this end has been defined by the cut made by the movable blade 69 by the anti-return roller 54. The free edge of this end has been defined by the cutting effected by the movable blade 69. During the movement of the carriage 20, the blade 69 is held in its raised position (or above the plane of the cut). This avoids the free edges of the ends striking the blade, which would be liable to occur if it were not in a raised position. Above the cutting region there are provided two plates 88 and 90 which define a vertical channel for passage of the ticket which has previously been cut off.

Figure 5:
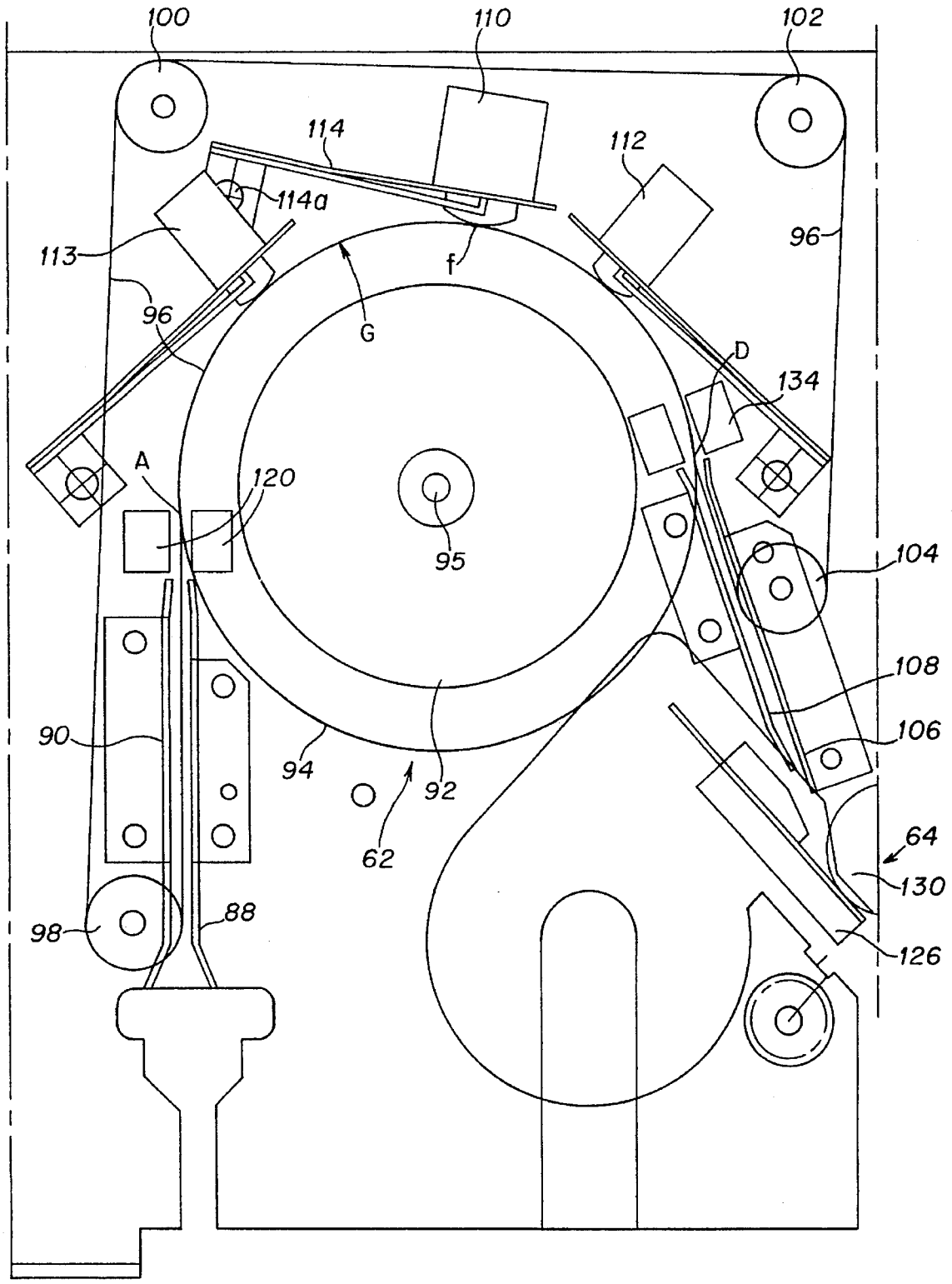
FIG. 5 is an elevation of the assembly inside the recording compartment.

Referring now more particularly to FIG. 5, the magnetic recording assembly 62 will be described. This essentially comprises a flywheel 92 pivotally mounted about a horizontal axis 95 integral with the frame of the compartment 12. The flywheel thus has a cylindrical peripheral wall 94. The assembly also comprises an endless belt 96 whose path is defined by rollers 98, 100, 102 and 104 mounted rotatably on horizontal pivots, or axes, integral with the frame. These rollers are so located that, over a part of its path, the belt is applied under pressure against a part of the peripheral surface 94 of the flywheel corresponding substantially to 180°. This is achieved in particular by the position of the rollers 98 located near to the entrance to the channel 88, 90 and by the roller 104 located near to a second, exit channel defined by the plates 106 and 108. It will be understood that, when a ticket cut off by the blade 69 is present in the entrance zone A, its leading end is nipped between the peripheral surface 94 of the flywheel and the belt 96. As will be explained later, the flywheel is caused to rotate at a constant speed. It will also be understood that, because of the friction between the belt 96 and the periphery of the flywheel 92, the belt is itself caused to move along the path defined by the rollers 98 to 104 in synchronism with the flywheel. The ticket is nipped between the belt 96 and the flywheel and thus follows the path between the entrance point A and the exit point D.

A magnetic write head 110 and preferably a magnetic read head 112 are mounted facing the part G of the periphery corresponding to the contact between the belt and the flywheel. The write head 110 is mounted on the end of a resilient arm 114 whose end 114*a* is fixed. The mounting is such that the distance f between the active face of the writing head in its position of rest and the periphery of the flywheel will be less than the thickness of a travel ticket, but this distance f will not be zero. It will be understood that, during the passage of the ticket between the writing head 110 and the periphery of the flywheel, the ticket causes limited flexure of the arm 114, which ensures contact between the magnetic track on the ticket and the write head during the whole passage of the ticket in front of this head. The read head 112 is mounted in the same manner at the end of the resilient arm 116 for exactly the same reasons.

The flywheel 92 has a very large mass compared with that of the ticket. Furthermore, the ticket is nipped effectively between the flywheel and the belt. The reaction from the lifting of the read head 112 by the leading edge of the ticket does not involve any disturbance to the speed of rotation of the flywheel and thus to the displacement of the ticket in front of the magnetic write head 110.

The detectors 120 are so disposed that, when they detect arrival of the free edge of the strip, the distance between this point of detection and the movable blade 69 is equal to the length of a ticket. This detection causes the drive roller 66 to be stopped and command movement of the movable blade 69 so as to cut off the ticket. More specifically, the detection signal is applied to the control circuits 18 of the ticket issuing device. These circuits perform an algorithm which allows a controlled delay to be introduced between the detection and the instant of the command for stopping the entraining roller 66. The position of the detectors 120 takes account of this delay.

Furthermore, the employee can modify this delay during initial setting up of the device, in order to adjust the actual characteristics of the device, so that the length of the ticket will be correct.

The detectors 120 also serve to control the magnetic write head when they detect the trailing edge of the ticket. Thus, the detection signal is transmitted to the control circuits 18 of the device, which introduce an adjustable delay between the detection and the control of the magnetic read head. The delay is fixed during initial setting up of the device. The adjustable delays allow fine mechanical adjustments to be dispensed with.

Figure 9:
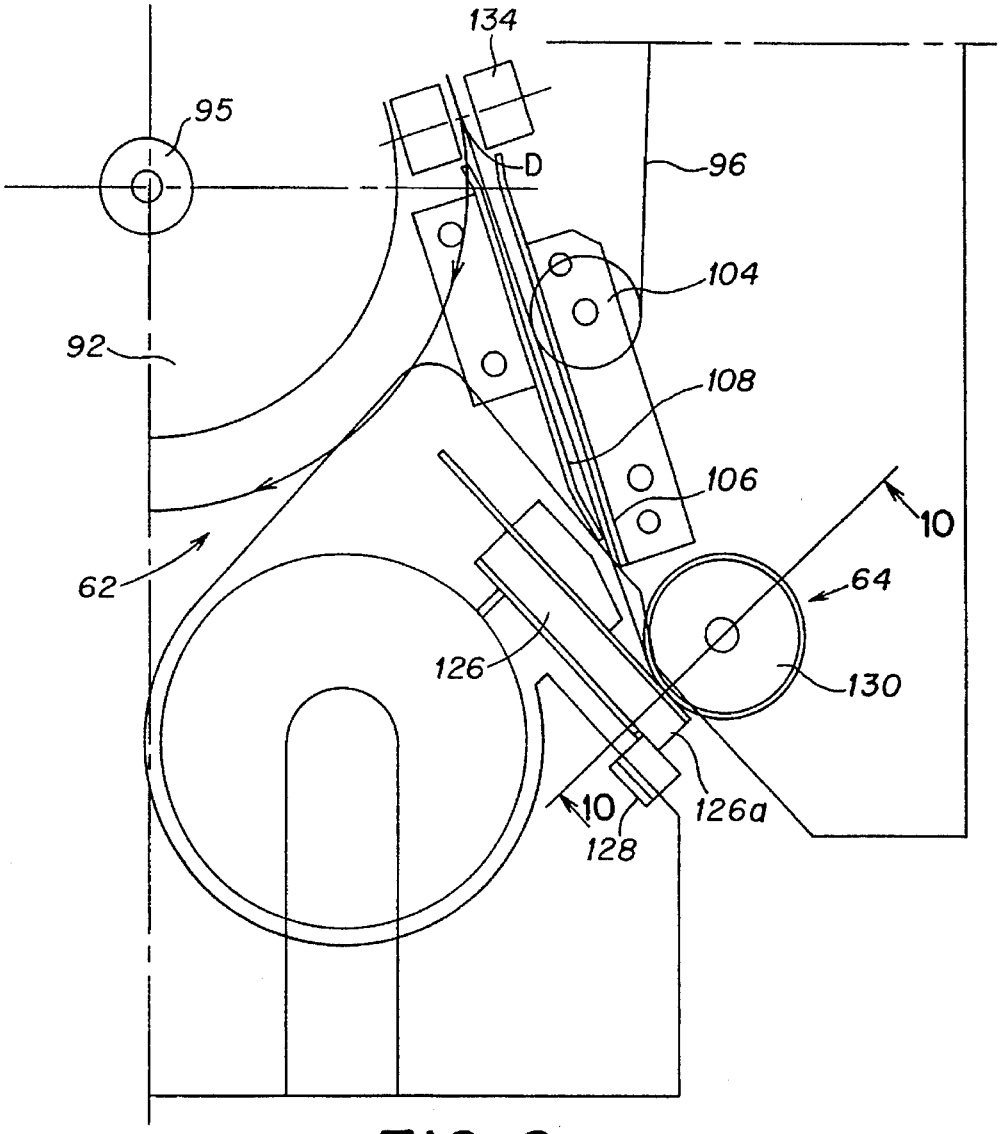
FIG. 9 is a partial elevation of the compartment showing the thermal printing means.
Figure 10:
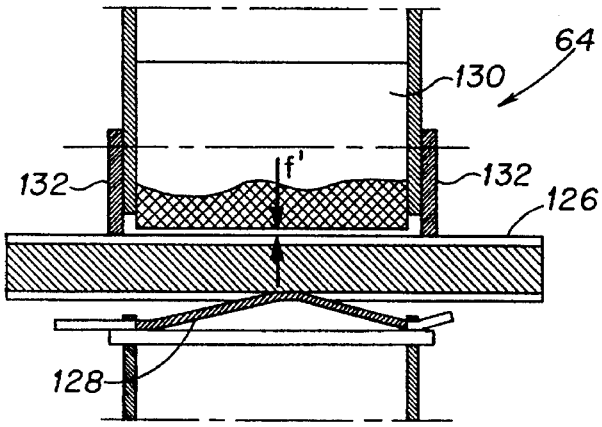
FIG. 10 is a section on the line X—X in FIG. 9.

Referring now more particularly to FIGS. 9 and 10, the thermal print assembly 64 will be described. The thermal head 126 is located at the exit of the channel formed by the plates 106 and 108. The active end 126*a* of the thermal head is mounted on the frame of the module by way of a leaf spring 128, as shown in FIG. 10. The thermal head 126, which is either a direct thermal print head or possibly a thermal transfer print head, cooperates with a pressure roller 130 facing the active part of the thermal head. The roller 130 is preferably made from elastomeric material. Thus, during the passage of the ticket between the roller 130 and the thermal head 126, the ticket causes slight retraction of the thermal head 126, because of its thickness, thus compressing the leaf spring 128. The pressure which results causes local flattening of the impression roller 130. There is thus very good contact between the print head and the area of the ticket to be imprinted.

As shown in FIG. 10, a reduced spacing f' is maintained between the thermal head 126 and the periphery of the printing roller 130. This spacing f' is less than the thickness of the ticket to be printed. In order to maintain this spacing f', mechanical stops such as 132 are advantageously provided and are integral with flanges on which the roller is mounted.

Furthermore, optical detectors 134 are preferably provided in the zone D corresponding to the end of entrainment of the ticket by the cooperation of the flywheel and the belt 96. When the detectors 134 detect the trailing edge of the ticket, the control circuit 18 of the device causes activation of the thermal print head 126. As in the case of the magnetic write head, an adjustable delay is preferably introduced by the control circuits 18 of the device.

For preference also, the distance between the movable cutter and the point A in FIG. 5 and the distance between the point B in FIG. 5 and the thermal impression roller are close to the standard length of a ticket.

FIG. 6 shows an embodiment of the drive to the various moving parts of the print module. A motor 140 causes the flywheel 92 to be driven via a belt 142. The same motor controls the drive to the print roller 130 through a gear train 144, 146 and 148.

The various parts of the recording module are preferably mounted on two vertical plates parallel to each other and parallel to the plane of FIGS. 5 to 9.

As to the recording module 12, it should be noted that it is normally locked on to the module 10 for storing rolls R, by means not shown in the drawings. The recording module 12 can only be unlocked when the carriage 20 has first been placed in the position in which there is no box B facing the opening 42. In relation to FIG. 2, this position is that in which the carriage 20 is pushed fully in the direction F1. Thus, when the recording module 12 is taken off, no end of a strip of medium appears in the opening 42, which is then accessible to the employee.

Figure 11:
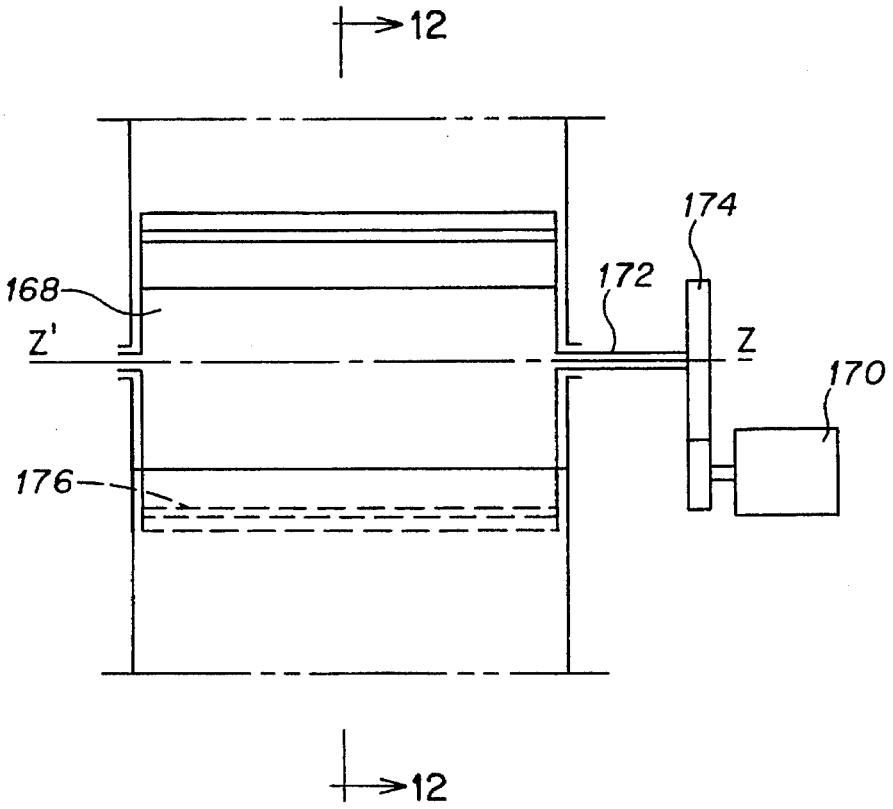
FIG. 11 is a partial elevation of output means of the device for issuing tickets.
Figure 12C:
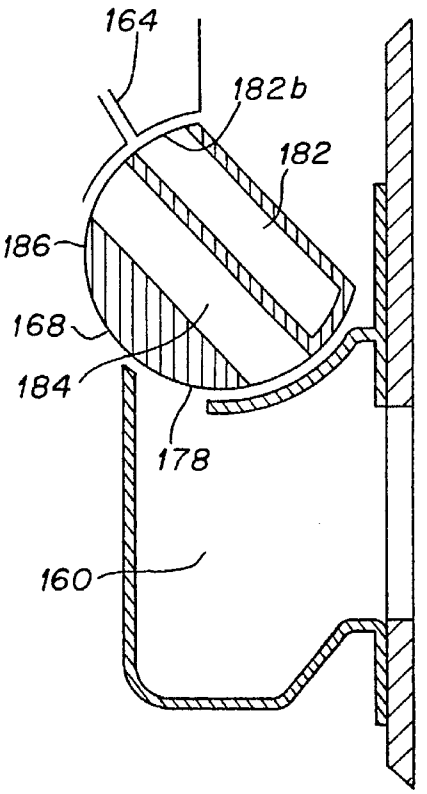
FIGS. 12*a* to 12*c* are sections on the line XII—XII in FIG. 11, showing the movable part of the output means in three different positions.

Referring now to FIGS. 11 and 12, a preferred embodiment of the outlet assembly of the ticket issuing device will now be described. This assembly is formed essentially in known manner by a tray 160 which opens to the outside of the device through an opening 162 allowing the user to pick up the ticket or tickets which have been prepared. According to the invention a movable member 166 is positioned between the channel 164 through which the prepared tickets exit and the tray 160 and performs a three-fold function. Firstly, it protects the device against attempted vandalism or fraud. Secondly it allows collection and storage of invalid tickets. Finally it allows temporary storage of valid tickets during the stage of payment for the tickets before actual issue to the user thereof.

Figure 12B:
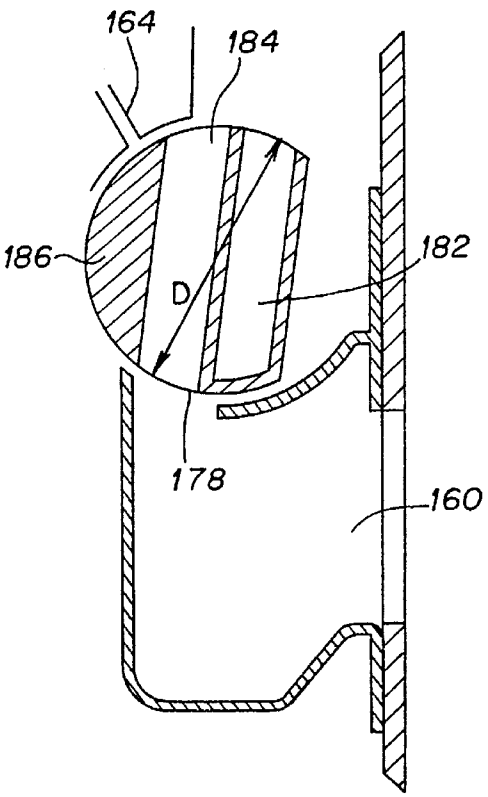
Figure 12A:
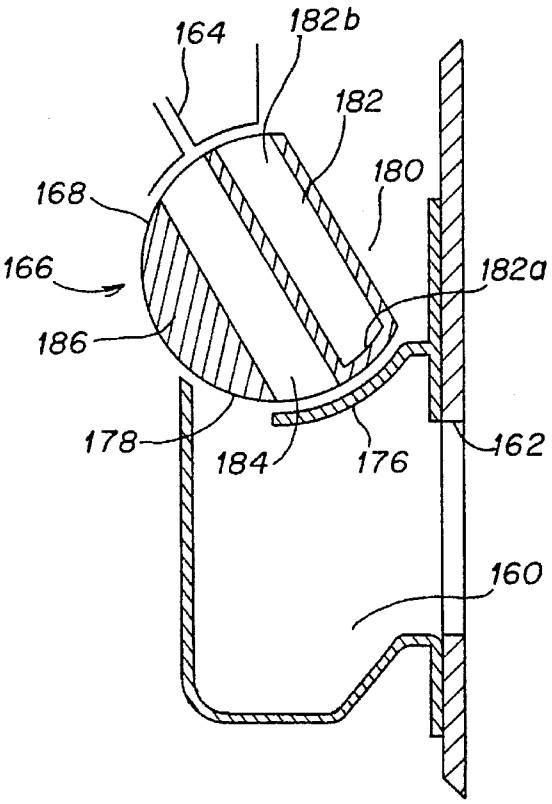

In the embodiment shown in FIGS. 11 and 12, the movable member 166 is formed by part of a cylinder 168 which is pivotally mounted about an axis ZZ' at right angles to the exit direction of the tickets. The part of a cylinder 168 can be rotated by a motor 170 connected to the spindle 172 of the cylindrical part by gearwheels 174. Referring now more particularly to FIG. 12*a*, it is seen that a portion of wall corresponding to a cylindrical sector 176 only leaves a reduced opening 178 between the actual tray 160 and the seat 180 in which the part 168 is mounted. The part 168 firstly defines a receptacle 182 for invalid tickets, this receptacle having a bottom 182*a* and a second, open end 182*b*. The part 168 also defines a passage 184 which extends from one side to the other of the cylindrical part. Finally, this part has a solid blocking portion 186.

The operation of the outlet device 14 is as follows. In the absence of output of a ticket, the part 168 is in the position shown in FIG. 12*a*, that is to say the passage 184 lies in extension of the channel 164, the second end of the passage is blocked by the wall 176 and the opening 178 is blocked by the portion 186 of this part. In this position, valid prepared tickets can collect inside the passage 184. When the payment has been effected and verified and the set of requested tickets is stored in the passage 184, the control circuits 18 of the device actuate the motor 170 so as to put the part 168 into the position shown in FIG. 12*b*, i.e. the part 168 executes a rotation which puts the lower end of the passage 184 opposite the opening 178, through which the accumulated tickets drop into the tray 160, where the user can pick them up. In the case in which the prepared ticket has been found to be invalid, the control circuits 18 of the device command the motor 170 to put the part 166 into the position shown in FIG. 12*c*. In other words, the open end of the invalid ticket receptacle 182 is brought opposite the channel 164. The invalid ticket is thus collected in the receptacle 182, where it is positively held until the next maintenance operation.

It is self evident that the diameter D of the cylindrical part 166 is a little greater than the length of a ticket and that the width of the passage 184 is made such as to allow simultaneous reception of the maximum number of tickets which can be ordered at the same time.

It should be emphasized that, save during the brief interval of time in which the cylindrical part 166 is in the position shown in FIG. 12*b* and which corresponds to the actual issuance of the ticket, the opening 178 is always blocked by the portion 186 of the rotary part. It will be understood that, by virtue of this arrangement, a cheat cannot attempt to block the ticket outlet in order to collect the tickets later fraudulently, without such blocking of the ticket outlet being visible.

Having described a preferred embodiment of the ticket issuing device in detail, the manner of operation and the manner of use will now be described.

As to the storage module for rolls of medium strip, the organization of the preferred embodiment is intended to avoid as far as possible maintenance personnel being able to steal a part of a roll or a roll. In the preferred embodiment, the carriage includes four roll boxes, two rolls pertaining to a first type and the other two rolls to a second type. Refilling is based on the principle that a roll can be changed only once it has been completely used up. This result is achieved firstly by the presence of the interlock 32 which only allows opening of a box by pivoting the wall 28, 34 if the control circuits 18 have detected that the roll is finished and have unlocked the interlock 32. Furthermore, this security feature is reinforced in that, in order to be able to open the box, the employee has firstly to bring the carriage into a position such that the box to be changed is opposite the cut-out 46 in the closure plate 44. Moreover, various identification systems at the start of a roll and recording the serial number of the employee effecting the changeover ensure that the new roll which is installed is in fact complete.

In order to install the roll, it will be understood that it is enough for the maintenance employee to engage the free end of the roll between the slides 56 and 58 and to put the end E of the strip into the seat formed by the folded strip 52. The anti-return roller 54 ensures that the end of the strip is kept in this position.

As to the recording module 12, its operation is clear from the description which has been given in conjunction with FIGS. 5 to 10. When the user has entered the information relating to the desired ticket or plurality of tickets with the aid of the interface means 16, the control circuit of the devices causes operation of the means for shifting the carriage 20 firstly to bring this into a position such that the first roll corresponding to the requested ticket is facing the window of the opening 42. The control circuit then activates the motor 71 which drives the roller 66, the counter-roller 68 moreover being in its active position and the blade 69 being in retracted position. The roller 66 causes withdrawal of the end of the strip which is engaged between the guide plates 88 and 90 until the detector 120 detects the leading end of the strip. As has already been explained, this detection causes the motor 71 to be stopped and the motor 72 to be started to cause firstly movement of the blade 69 so as to cut off the ticket and, at the end of this stage, retraction of the counter-roller 68. The leading edge of the ticket thus cut off is nipped in the zone A between the belt 96 and the periphery 94 of the flywheel 92. This moves the cut ticket until its rear edge is detected by the detectors 120, which then command actuation of the magnetic write head 110. The ticket continues to rotate on the flywheel 92, passing in front of the read head 112 which verifies that the magnetic information has been correctly recorded. In addition, the distance between the detector 120 and the write head is such that it allows verification that the length of the ticket is right. In a preferred embodiment, partially random magnetic information can be recorded on the magnetic track and be read by the read head 112 in order to ensure that no prior fraudulent actions have been effected on the strip. If the length of the ticket is not right or if the magnetic information is not right, an error signal is sent to the control circuit 18 of the device, which causes the invalid ticket to be trapped.

In the following stage, the ticket is freed from the flywheel 92 and the detectors 134 then detect the trailing edge of the ticket and the thermal printing head 126 is commanded to print the information corresponding to the selected ticket. Finally the ticket reaches the rotary member 166 through the channel 164, which member is disposed either in the position of FIG. 12*a* if the ticket is valid or in the position of FIG. 12*c* if the ticket is invalid. If the ticket is valid it is retained in the passage 184 until the set of tickets requested has been prepared and stored temporarily in the passage 184. When all the tickets have been brought into the passage 184 and when the user has paid the amount corresponding to the ticket required, the control circuits 18 cause operation of the motor 170 so as to put the rotary part 166 into the position shown in FIG. 12*b*, so that the tickets fall into the tray 160.

As to the question of security it should be noted that, within the recording module 12, the ticket is guided entirely either by the two sets of plates 88, 90 and 106, 108 or by the cooperation of the flywheel 92 and the belt 96 during the whole of its path between the drive roller 66 and its passage in front of the thermal printing head 128. It is thus impossible for an employee to introduce a part into the recording module which allows diversion of the ticket from its normal path, in order to recover it later in fraudulent manner.

It is also necessary to emphasize that, because of the regularity of entrainment of the ticket by the flywheel, the writing and reading of the magnetic information can take place during a single displacement of the ticket in one direction only which is the general direction of movement of the ticket in the recording module. This arrangement increases the security of operation and allows continuous drive of the flywheel, which avoids many causes of failure.

It should further be noted that, when the maintenance employee needs to remove the recording module from the roll storage module, the removal can be effected only when the end of a strip of medium is out of reach of the employee. This prevents the employee from removing part of the strip of medium fraudulently.

It is self-evident that numerous variations on the device for preparing and issuing tickets described above can be envisaged. In particular the rotatable movable part 166 of the outlet device for the tickets can be replaced by a part fulfilling the same functions but moving linearly. It then takes the form of a drawer fulfilling the three functions set out above.

In the same manner, instead of providing a carriage 20 moving relative to the recording and printing module 12, the carriage could be fixed and the means inside the recording module 12 for cutting off the ticket, for entraining the ticket, and for recording on the ticket magnetically and thermally could themselves be movable to take up a position opposite the box in the carriage containing the roll of medium strip to be used.

It will also be understood that the magnetic recording module 62 could have the flywheel mounted freely rotatable about an axis and that the endless belt 96 could be driven by a motor in one direction only and at a constant speed. The flywheel 92 will then be rotated by the friction between the belt and the periphery of the flywheel.

Finally, it should be noted that the means for recording information on the tickets in accordance with the invention have been described by way of example in combination with a ticket issuing machine which comprises specific ticket medium supply means and particular ticket issuing means. It is self-evident that the means for recording tickets could be used with different supply means. For example, the tickets could be stored in precut form, the magnetic recording module then would not include the means for cutting the strip of medium. Equally, the pre-cut tickets could already carry the printed items of graphical data, the recording module serving solely to write and check the information in magnetic form.

In order to further improve the security of operation of the device for preparing and issuing tickets and more particularly to give better protection to the blank ticket medium against attempts at theft by maintenance employees for the device, the invention also concerns use of the following features:

Each roll of physical medium strip is initially enclosed in a transparent, sealed envelope. This allows detection of any attempts at theft before placing the roll in the device.

In order to prevent theft of the start of the strip when it is put into the storage box, the leading end of the strip carries a special mark and possibly a strip number created during the manufacture of the strip. While the device is being put into operation after the roll has been loaded in the corresponding box, the first ticket which is withdrawn and which corresponds to the initial portion of the strip is printed in a special way. The thermal printer is, for example, commanded in this initial stage to print information identifying the employee, who is identified before gaining access to the inside of the machine, for example by the machine reading an identification card. The machine also prints the number of the re-loaded machine, the number of the re-loaded box, the date, etc. The employee keeps this coupon as proof that re-loading has been performed properly.

Another device is provided to prevent removal of part of the strip and sticking the leader of the strip back on again to conceal this fraudulent removal. For this purpose the magnetic track of the strip is pre-coded with sequences of increasing or decreasing numbers 0 to N, the value of N being varied randomly. The interval between two successive recorded numbers is such that the length of the strip corresponds to a ticket being prepared that carries a plurality of numbers.

In this case, the recording module of the device comprises a supplementary magnetic read head 113 facing the part of the flywheel 92 on which the ticket is entrained. This head is disposed before the write head in the direction of displacement of the ticket. This read head reads the sequence of numbers printed on the magnetic track of the ticket and erases them during reading, which makes it possible for the ticket to be re-coded by the head 110. If these numbers are not in sequence or if a detected discontinuity does not correspond to passage from N to 0 or from 0 to N, fraud has taken place and the machine is for example put out of action.

Finally, in order to avoid a strip being changed in a box when there still remains a length greater than that of one ticket, it is advantageous to provide the following measures:

It is very difficult to make a machine which allows the spool of the strip of medium to be used up completely. It is possible for there to remain a length of medium which is greater than the length of a ticket but which will nevertheless be detected by the strip detector as a "finished" strip. In order to prevent the employee recovering this remaining strip, the effective end of the strip is marked over a sufficient length (for example over less than the length of a ticket, say over about 50 mm) in such a manner that this part of the strip is unusable. In addition, the last ticket removed from a strip (the operation which causes operation of the end of strip detector 59), which may comprise a marked part, is always coded and printed during its passage in front of the write head 110 in such a manner as to be invalid. As a result, the corresponding ticket will be trapped in the enclosure 182 of the output assembly 16. More specifically, the length of the marked part depends on the distance between the point A of the movable cutter, on the distance between the movable cutter and the anti-return roller, and on the position of the end of strip detector 59.

It will be understood that such a strip of ticket medium has characteristics described above and which are particularly well adapted for use in a device for preparing and issuing tickets described with reference to FIGS. 1 to 12. However, it is self-evident that such a roll could be used in other devices for issuing tickets, provided that these devices comprise means for detecting and making use of specific security information carried by the roll.

We claim:

1. A device for preparing and issuing tickets carrying information in magnetic form comprising means for providing portions of recording physical medium having the length of a ticket, means for recording magnetic information on the recording medium and means for issuing tickets, wherein the ticket preparing means comprise magnetic writing means which comprise:

a flywheel pivotally mounted about an axis and having a peripheral surface;

a flexible, endless belt for entraining portions of ticket medium;

entraining means for causing displacement of one of the two parts constituted by the belt and said flywheel, guide means for said belt such that the path followed by said belt has a part in which it is applied under pressure to a peripheral part of the peripheral surface of the flywheel, through which the two parts are entrained by mutual friction;

means for engaging a first end of a portion of ticket medium between the part of said belt that is in contact with the periphery of said flywheel and the peripheral surface of said flywheel, whereby said portion of medium is entrained by the rotation of said flywheel through nipping between the belt and the peripheral surface over the part of its periphery to which said belt is applied, then freed outside said peripheral part; and magnetic recording means disposed opposite the part of the peripheral surface of the flywheel to which said belt is applied.

2. A device according to claim 1, wherein said flywheel is connected to rotary entraining means.

3. A device according to claim 1, further comprising means for entraining the end of the strip of physical medium and means for cutting off portions of the strip corresponding to the desired length of a ticket.

4. A device according to claim 3, comprising plate means defining a protected passage for said tickets between the cutting means and the point of nipping between said flywheel and said belt.

5. A device according to claim 1, further comprising thermal printing means and plate means defining a protected passage for said tickets between the point of release of tickets from said flywheel and said thermal printing means.

6. A device according to claim 3, wherein means for entraining the end of a strip comprise an entraining roller whose axis of rotation is fixed and a counter-roller whose axis is movable between a first position in which it grips the strip of medium in cooperation with said entraining roller, and a second position in which it is spaced relative to said entraining roller.

7. A device according to claim 6, comprising means for retracting said counter-roller when the cutting means have finished the operation of cutting off the strip of medium.

8. A device according to claim 1, wherein said magnetic recording means comprise a magnetic write head mounted on the end of a flexible arm in such a manner that, at rest, the space between said write head and the periphery of said flywheel is less than the thickness of a ticket.

9. A device according to claim 8, wherein the magnetic recording means further comprise a magnetic read head disposed opposite the part of the peripheral face of the flywheel to which said belt is applied.

10. A device according to claim 5, wherein said thermal printing means comprise a thermal print head and a printing roller opposite said print head, said roller being connected to means for effecting rotation at a constant speed.

11. A device according to claim 10, wherein the thermal print head is mounted on the frame of said device by way of elastic means biasing said head towards said printing roller, said thermal print head having means for maintaining a space between itself and the periphery of said printing roller less than the thickness of a ticket.

12. A device according to claim 1, comprising testing means for testing whether a prepared ticket is valid or not and wherein said means for issuing valid tickets comprises a guide channel for tickets which have been prepared, a receptacle for prepared valid tickets, said receptacle being provided with an external opening allowing users to take hold of a ticket, a seat in communication with the end of the guide channel and in communication with said receptacle through an outlet opening of small dimensions adapted to allow passage of a ticket, movable means mounted on said seat, said movable means comprising a first surface and a second surface and defining a collecting enclosure for invalid tickets, a passage extending between said first and second surfaces and adapted to contain a ticket, and blocking means for blocking the end of said channel and said outlet opening, and means for shifting said movable means between a first position in which one end of said passage faces the end of said channel and in which the other end does not face the outlet opening, and in which the blocking means block said outlet opening, a second position in which said collecting enclosure faces the end of said channel and in which said blocking means block said outlet opening, and a third position in which said blocking means block the end of said channel and in which the second end of said passage faces said outlet opening.

13. A device according to claim 1, further comprising means for supplying physical medium for preparing tickets, wherein the supply means comprise a receptacle, movable in a direction XX', for receiving n rolls of physical medium strip, each roll being adapted to rotate about an axis YY' parallel to the direction XX', said rolls being disposed side by side in such a manner that their axes of rotation are parallel, an enclosure in which said receptacle is movably mounted, said enclosure having a fixed wall substantially parallel to said direction of movement and provided with an opening adapted to allow passage of said strip of physical medium, said opening opening into a space of said device containing said means for preparing tickets, n anti-return devices integral with said receptacle, each anti-return device being adapted to keep the free end of a strip opposite said opening, said anti-return means in the active position only allowing unreeling of said roll and means for shifting said receptacle in the direction XX' in order to place the free end of a selected one of said n strips opposite said opening.

14. A device according to claim 1, comprising means for recording identifying information of an employee carrying out maintenance, wherein the initial end portion of each roll of strip for tickets carries a special mark, and wherein said ticket preparing means comprise means for imprinting said information identifying the employee and information identifying the device on said initial end portion, and means for cutting said initial end portion off the strip to obtain a voucher indicating that the device has been loaded.

15. A device according to claim 14, wherein said strip has a magnetic recording track, wherein said magnetic track has a plurality of sequences of consecutive integers 0 to Ni or Ni to 0, where i is variable, the numbers Ni being pseudo-random, and each length of strip corresponding to a ticket including at least two numbers, and wherein the ticket preparing means comprise means for detecting a discontinuity in the succession of numbers which are read, which discontinuity is other than a transition from 0 to Ni or from Ni to 0.

16. A device according to claim 13, wherein said movable receptacle has n end of medium strip detectors, each detector being mounted upstream of one of the n anti-return means.

17. A device according to claim 16, wherein the end portion of each strip of physical medium has a marked final part of predetermined length and wherein said magnetic information recording means are commanded to write information invalidating the ticket in course of preparation in response to activation of the end of strip detector.

18. A device according to claim 3, further comprising means for detection of the leading edge of a ticket in course of preparation and means for commanding the entraining means for the end of a strip of physical medium to stop in response to said detection, said command means comprising software means for introducing an adjustable delay.

19. A device according to claim 3, further comprising means for detection of the trailing edge of a ticket in course of preparation, and means for commanding activation of the magnetic recording means in response to said detection, said command means comprising software means for introducing an adjustable delay.

20. A device according to claim 5, further comprising means for detection of the trailing edge of a ticket in course of preparation, and means for commanding activation of the thermal printing means in response to said detection, said command means comprising software means for introducing an adjustable delay.

21. A roll of physical medium strip for a device for preparing and issuing tickets which comprises means for cutting off the strip of physical medium to the length of a ticket, means for recording information identifying an employee maintaining said device and means for printing said identifying information on the initial end portion of said strip, wherein said initial end portion of the strip carries a special mark.

22. A roll of strip according to claim 21 for a device for preparing and issuing tickets which further comprises magnetic reading means, wherein said strip has a magnetic track over its whole length and wherein sequences of consecutive integers from 0 to Ni or from Ni to 0, where i is variable, are recorded on said magnetic track over the whole length of the strip, the numbers Ni being pseudo-random, each length of strip corresponding to the length of a ticket comprising at least two numbers.

23. A roll of physical medium strip according to claim 21, wherein the end portion of the strip has a marked final zone of predetermined length.

* * * * *